United States Patent [19]

Torokvei

[11] 4,040,517

[45] Aug. 9, 1977

[54] STACKING CASE

[75] Inventor: Thomas Evald Torokvei, Don Mills, Canada

[73] Assignee: Scepter Manufacturing Company Limited, Toronto, Canada

[21] Appl. No.: 638,358

[22] Filed: Dec. 8, 1975

[51] Int. Cl.[2] ..... B65D 1/24; B65D 1/36; B65D 85/54

[52] U.S. Cl. ..... 206/144; 206/203; 206/493; 206/506; 206/510; 220/21

[58] Field of Search ..... 206/144, 194, 198, 203, 206/427, 433, 443, 446, 493, 506, 510; 220/21, 23.6

[56] References Cited

U.S. PATENT DOCUMENTS

| | | | |
|---|---|---|---|
| 2,377,520 | 6/1945 | Robinson, Jr. et al. | 206/510 |
| 2,588,805 | 3/1952 | Cross | 206/433 |
| 2,804,985 | 9/1957 | Cross et al. | 220/21 |
| 2,821,327 | 1/1958 | Glazer | 206/203 |
| 3,106,308 | 10/1963 | Kazimier | 220/21 |
| 3,283,947 | 11/1966 | Cornelius | 206/203 |
| 3,297,196 | 1/1967 | Cornelius | 206/203 |
| 3,349,943 | 10/1967 | Box | 220/21 |
| 3,391,814 | 7/1968 | Box | 220/21 |
| 3,392,869 | 7/1968 | Neept | 220/21 |
| 3,404,805 | 10/1968 | Stockman et al. | 220/23.6 |
| 3,405,840 | 10/1968 | Champlin | 206/196 |
| 3,587,915 | 6/1971 | Theobald | 206/203 |
| Re. 25,707 | 1/1965 | Chelbor | 206/203 |

FOREIGN PATENT DOCUMENTS

| | | | |
|---|---|---|---|
| 674,883 | 11/1964 | Italy | 206/510 |
| 1,207,268 | 12/1965 | Germany | 220/21 |

*Primary Examiner*—William Price
*Assistant Examiner*—Bruce H. Bernstein
*Attorney, Agent, or Firm*—Blakely, Sokoloff, Taylor & Zafman

[57] ABSTRACT

A carton for carrying a plurality of bottles, the carton having a stacking capability when both empty and when filled with bottles. Registration for stacking of empty cartons is provided by reception of the handles of each carton in a recessed open area in the bottom of the next carton in the stack. Each carton comprises side and end walls connected in a generally rectangular shape, a central dividing member having an extension thereof forming a handle, partition walls cooperating with the central dividing member to form cells for holding bottles, and a carton bottom coupled to the partition walls and central member. The carton bottom, partition walls and central dividing member are relieved so as to form a slotted region for receiving the handle of a similar empty carton therebelow. Appropriately disposed upward protrusions on the carton bottom maintain the separation of bottles in the relieved region of the carton.

9 Claims, 5 Drawing Figures

STACKING CASE

This invention relates to a bottle carrying carton and case.

The prior art known is as follows: U.S. Pat. No. Des. 210,930, Box, U.S. Pat. No. Des. 160,608, Jones, U.S. Pat. No. Des. 202,303, Struble, U.S. Pat. No. Des. 237,686, Torokvei, U.S. Pat. No. 3,404,805, Stockman et al.

Box discloses a bottle carrier for carrying six bottles, comprising six open hollow cylindrical cells for holding the bottles, the cells being joined together in two rows of three cells, and having a handle connected to the carrier along the connection of the two rows of cells. A number of openings are formed in the bottom of each cell.

Jones shows a bottle carrier formed of six open cells coupled together at the top, and having a sliding handle. Each side of the handle comprises a cylindrical rod inserted into a hole in the top of the carrier and having stops formed thereon so that the handle slides out to a fully extended position when lifted. When the handle is not in use, the handle slides downward to a depressed position.

Struble discloses the top of a carrier for bottles, comprising a rectangular frame defining the upper portion of six bottle cells and a handle portion extending upward and longitudinally along the central partition of the top.

Torokvei discloses a bottle carrier comprising six cylindrical cells, each formed by circular top and bottom members. The cells are joined at the tops thereof in two rows of three cells each, with a handle member extending upward between the two rows.

None of the above bottle carriers discloses a bottle carrier adapted to receive the handle of a similar carrier located in a stacked relationship below. Stockman does show a carton having a bottom slotted to receive the handle of a carton stacked below, though such feature is obtained by a double central partition between the two rows of cells, forming a sleeve for the upwardly inserted handle member of a next lower case in a stack. The double sleeve creates additional weight and requires more material than is necessary. It also results in a wider carton than necessary in order to accommodate the double sleeve.

It is an object of the present invention to provide a bottle carrying carton which may be molded of plastic.

It is an object of the present invention to provide a plastic bottle carrying carton wherein side, end and partition walls divide the carrying carton into cells, a bottom support for the bottles is provided in each cell, the bottom support being joined to adjacent ones of said walls forming the cell walls, and the bottom support is maintained spaced from any supporting surface on which the carton rests, whereby a cushioning effect is achieved when a bottle is placed in the carton.

It is an object of the present invention to provide a plastic bottle carrying carton wherein side, end and partition walls divide the carrying carton into cells, a bottom support for the bottles is provided in each cell, said bottom support being shaped to form an upward facing convexity shaped to be received in the downward facing concavity of a bottle in said cell, whereby the bottle is inhibited from sideways movement on the support.

It is an object of the present invention to provide a plastic bottle carrying carton wherein side, end and partition walls divide the carrying carton into cells, a bottom support for the bottles is provided in each cell, said bottom support being shaped to form a downward facing concavity shaped to receive the cap of a bottle in a similar case below, whereby when a plurality of such cases are provided filled with bottles, such cases may be stacked with the caps of bottles in a lower case, received in concavities of an upper case.

It is an object of the present invention to provide a plastic bottle carrying carton which may be stacked when empty wherein side, end and partition walls divide the carrying carton into cells, a bottle support for the bottles is provided in each cell, said partition walls include a longitudinally extending central dividing wall and an upright handle is formed of an upward extension of the central dividing wall. The capacity of the cartons to be stacked, when empty, is achieved by the provision of a member joining adjacent bottom supports defining a slot to receive the handle of a similar carton located therebelow and by removing the material of the central dividing wall above said slot to receive the upwardly projecting handle located therebelow. The slot and removed portion of the central partition not only provide for relatively close stacking of such vertically, adjacently disposed cartons, but further provide for registration between such cartons so that they cannot move horizontally relative to each other.

The removal of a portion of the central dividing wall, as referred to in the previous paragraph, tends to allow contact between bottles on opposite sides of said central dividing wall. The development in the form described in the previous paragraph is therefore preferably provided with raised portions on the corresponding bottom support members which prevent a bottle in a corresponding cell from moving toward the adjacent bottle on the other side of the location of the cut-away portion.

In its most specific aspects the invention provides a carton defining a plurality of cells for carrying a corresponding plurality of bottles, wherein the carton provides cushioning for the impact of bottles inserted by hand or by machine therein, and wherein the design of the carton is such that it may be stacked empty or full and registration means are provided so that shifting of stacked cartons relative to each other is prevented or inhibited and centering of the bottles in their respective cells is provided for.

In drawings which illustrate a preferred embodiment of the invention:

Figure 1:
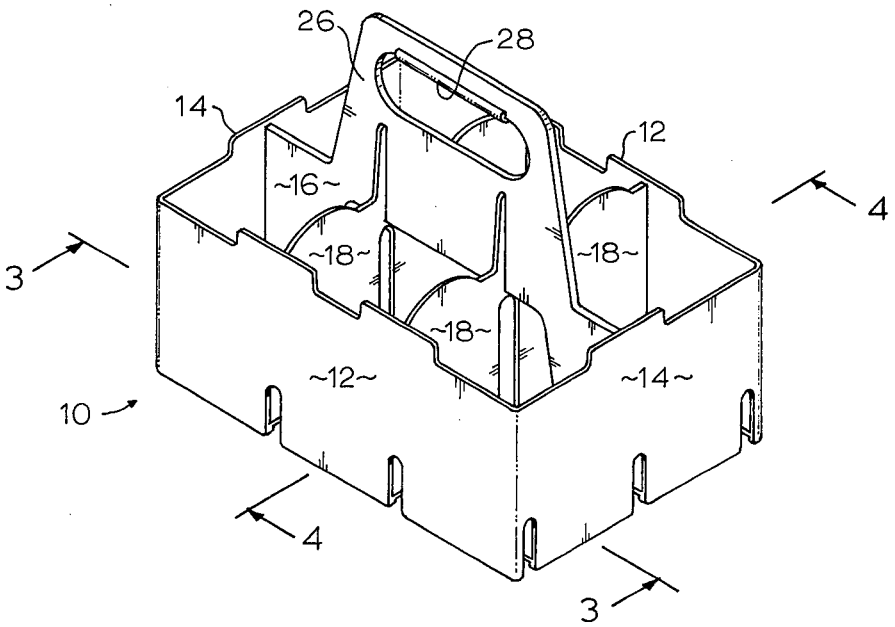
FIG. 1 shows a top perspective view of the new carton.
Figure 2:
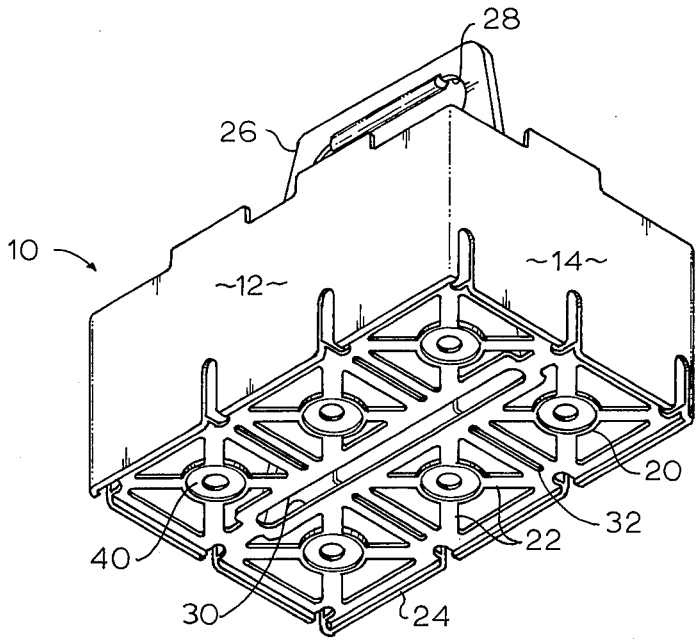
FIG. 2 shows a bottom perspective view of the carton.

In the drawings is shown a carton 10 generally rectilinear in plan view and having side walls 12, and end walls 14. The carton is provided with a longitudinally extending central dividing wall 16 generally parallel to the side walls and oriented to conform generally to a vertical plane in the upright attitude of the carton.

The carton including the elements previously described and those about to be described, is designed to be molded from plastic in a single or 'one shot' molding operation. Although a number of plastics are suitable for this purpose, (and these are well known to those skilled in the art), it is preferred to use high density polyethylene for this purpose.

The carton herein described is designed to replace the cardboard cartons generally in use. Although the U.S. Pat. No. to Stockman et al 3,404,805 shows a plastic carton for a similar purpose this patent lacks the features claimed herein. Inter alia Stockman does not show a carton wherein the bottles are cushioned when inserted as in the construction of the present invention. Stockman does not show a carton where the concave bottle bottoms register with upward facing convexities as in the present construction. Stockman does not show a carton where portions of the bottom are provided with downwardly facing concavities to register with the caps of the bottles in the case below, when the cases are stacked in full position. Stockman does show a carton wherein the bottom is slotted to receive the handle of a carton stacked therebelow. However, the Stockman design requires a double central partition to form a sleeve for the upwardly inserted handle member. The present invention avoids the excess weight and expense involved in the Stockman arrangement by removing a portion of the central partition to receive the central partition of the case below and by making provision to prevent movement of the bottles toward each other across the area where the bottles have been removed.

Returning to the drawings, partition walls 18 are provided to form a rectilinear grid of approximately square cells for bottles and the walls 18 are joined to side, end or central partition walls, as shown to receive their necessary support.

Although the carton shows provision for only a single row of bottles on each side of the central partition, the design may if desired provide for multiple rows on each side.

Each cell is provided with a bottom support member 20 for a bottle. The support member 20 is located approximately centrally in the bottom of the cell. The support member is supported by arms 22 extending from the sides or corners of the cells (here the corners). The arms 22 are made in a form thin in the vertical dimension so that they are slightly bendable about a horizontal axis allowing the bottle support member to deflect upwardly and downwardly under vertical impacts. This forms part of the cushioning for bottles which is a feature of this development.

The carton at the downward projection of the side and end walls is provided with a downwardly extending peripheral edge 24 which supports the carton on a support surface with the bottom support members 20 above the support surface. Thus the bottom support members 20 are maintained clear of the bottom support surface and free to deflect downwardly when a bottle is inserted by any means therein, providing a large part of the desired cushioning effect.

Figure 3:
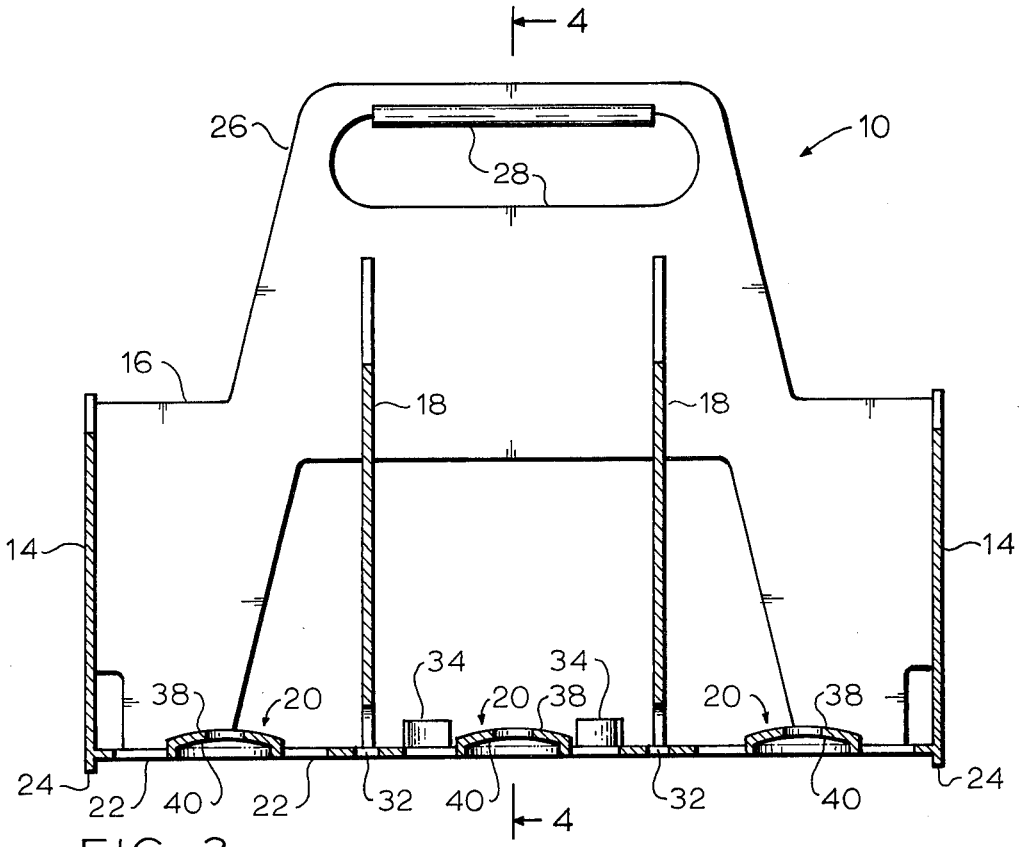
FIG. 3 shows a cross-section along the lines 3—3 of FIG. 1.
Figure 4:
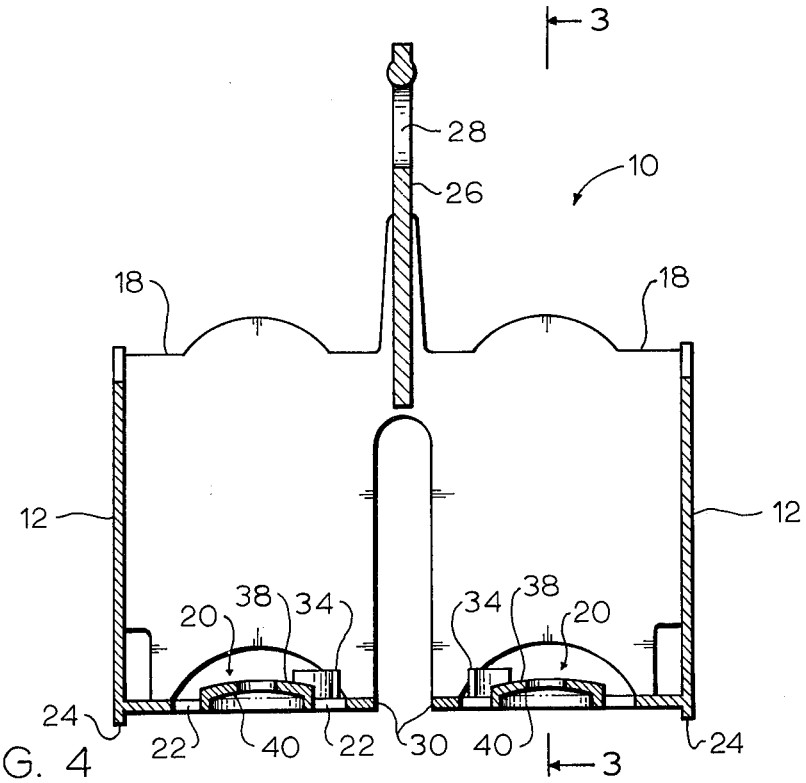
FIG. 4 shows a cross-section along the lines 4—4 of FIG. 1.
Figure 5:
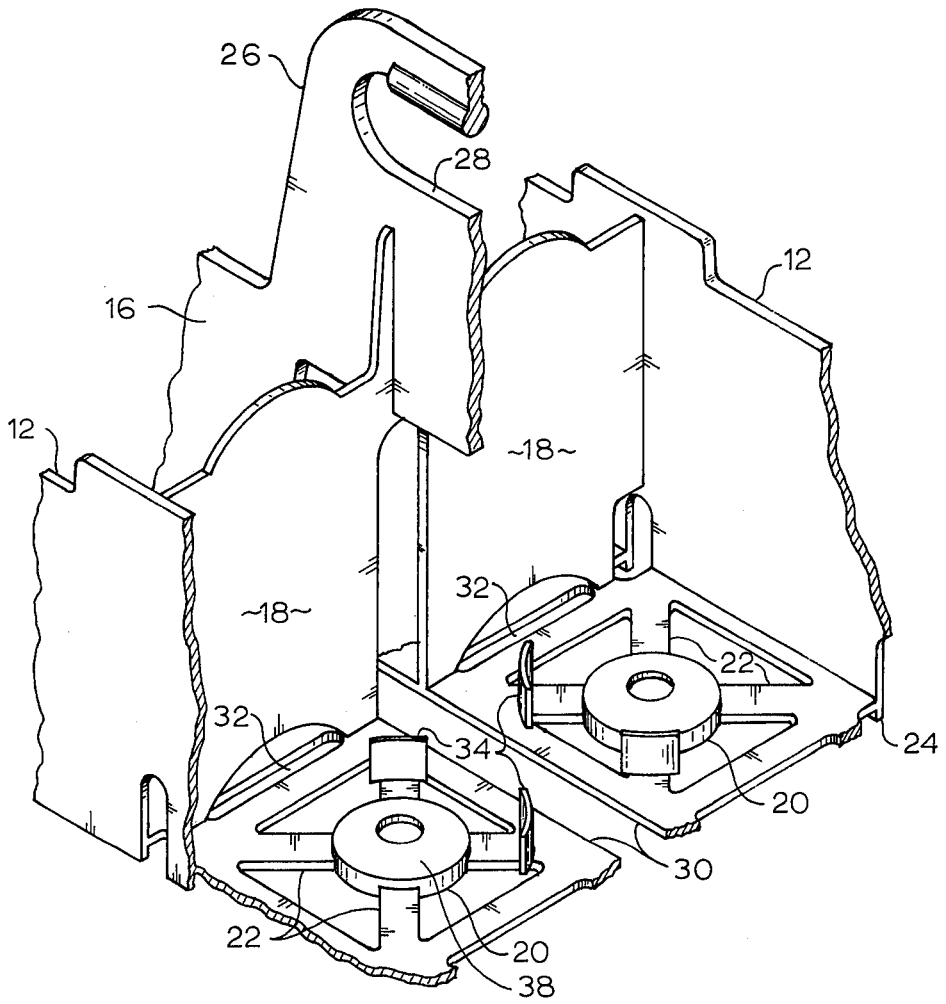
FIG. 5 shows a view of parts of the carton seen by looking downwardly thereon.

The longitudinally extending central dividing wall 16 is extended upwardly at 26 to provide a handle forming member defining manual grasping aperture 28. The horizontal length of the handle forming member 26 is shorter than that of the central dividing wall so that provision may conveniently be made to house the upwardly extending handle forming member 26 in another carton of similar construction. A member 30 is provided joining the bottom support members adjacent the downward projection of central dividing wall 16 to form a slot dimensioned to receive the handle forming member of a similar carton therebelow, when the cartons are stacked. Above the slot the central dividing wall 16 is removed at R in FIG. 3 to a degree to receive the handle forming member 26 of a similar carton stacked therebelow. The cartons may thus be stacked in empty or full condition; the registration between the handle forming member 26 of a lower carton and the slot, defined by member 30 in the upper carton providing alignment between the stacked cartons. The unique shape of the bottles produced by the Coca-Cola Company makes it preferable to make the upper edges of the cell partitions walls 18 convex upwardly to separate the bulging portions of the Coca-Cola bottle. Where such convex upward edges are provided the bottom of the partition walls is correspondingly slotted as shown at 32 to receive the convex edges of the lower carton partition walls when the cartons are stacked.

The removal of a lower central portion of the dividing wall 16 to allow stacking removes the cell wall between one or more pairs of cells (here one pair) on opposite sides of the central partition. To avoid contact between the bottles in such cells adjoining across the central partition, cleats 34 are provided on the relevant arms 22 to limit movement of a bottle in the relevant cell toward the bottle in the adjoining cell across the area where the dividing wall has been removed.

The bottom support members are preferably made convex upwards as shown at 38 and shaped to be received in the downward concavity with which a bottle is normally provided. This convexity 38 serves two purposes. First it serves to center the bottle in the cell. Secondly, because the bottle will nearly always be supplied to the cell slightly off center, additional cushioning is provided by the bottle while centering itself over the convexity.

The bottom support members are preferably made concave downwards as shown at 40 and shaped to receive the caps of the bottles of a similar carton stacked below. This assists the registration between the cartons and the bottles therein and to some extent cushions the impact when one bottle is set on the other.

I claim:

1. A carton of generally rectangular shape in plan view for carrying a plurality of bottles comprising:

means for defining side and end walls;

a single wall constituting a vertically and longitudinally extending central dividing member having oppositely disposed surfaces, said single wall having a recess upwardly extending from its bottom edge for a predetermined distance, said recess forming an opening through said oppositely disposed surfaces;

partition walls cooperating with said single wall and said means for defining side and end walls to divide the carton into a plurality of cells for receiving bottles;

upright handle means connected to said single wall and located above said means for defining said side and end walls;

said recess of said single wall being proportioned to receive the handle means of a similar empty carton when in stacked relationship; and means coupled to said partition walls and said single wall for defining for each of said cells a bottom support for a bottle placed in said cell, said last named means being open in the region of said recess of said single wall.

2. The carton of claim 1 wherein the bottom support means for cells adjacent said recess of said single wall is provided with upward projecting cleat means for maintaining the separation of bottles on opposite sides of said recess of said single wall.

3. The carton of claim 1 wherein said partition walls have slots adjacent the bottom thereof in the region of said recess of said single wall for receiving a handle means of an empty carton stacked beneath said carton.

4. The carton of claim 1 wherein said handle means is formed of an upward extension of said single wall.

5. The carton of claim 1 wherein each of said bottom support means is shaped to form a downwardly facing concavity, said concavity being shaped to at least partially receive the cap of a bottle below said carton.

6. The carton of claim 1 wherein each of said bottom support means is shaped to form an upwardly facing convexity, said convexity being shaped to at least partially enter the concavity of a bottle placed in said cell.

7. The carton of claim 1 wherein said carton is of one piece molded construction.

8. A carton of generally rectangular shape in plan view for carrying a plurality of bottles comprising:

means for defining side and end walls;

a single wall constituting a vertically and longitudinally extending central dividing member having oppositely diposed surfaces extending between said end walls, said single wall having a recess extending upwardly from the bottom thereof to form an opening through said oppositely disposed surfaces of said single wall, said single wall further having an integral upper portion extending above said side and end walls, said upper portion having an opening therein adjacent the top thereof to form a manual grasping aperture;

said recess of said single wall being proportioned to receive the upper extending portion of said single wall of a similar empty carton when in stacked relationship;

partition walls cooperating with said single wall to divide the carton into a plurality of cells adapted to contain bottles, each of said partition walls having a slot defined by interior edges of said partition walls, each of said slots extending upwardly from the bottom of said partition walls in cooperation with said recess of said single wall;

bottom support means coupled to said partition, side and end walls for defining for each of said cells a bottom support for a bottle placed in said cell, said bottom support means having an opening cooperatively disposed with respect to said single wall and said partition walls to extend said slots in said partition walls and said recess in said single wall through said bottom support means; and cleat means adjacent said recess of said single wall for preventing movement of bottles placed therein through said recess and into contact with one another.

9. The carton of claim 8 wherein said carton is of one piece molded construction.

* * * * *

UNITED STATES PATENT OFFICE

CERTIFICATE OF CORRECTION

Patent No. 4,040,517 Dated August 9, 1977

Inventor(s) Thomas Evald Torokvei

It is certified that error appears in the above-identified patent and that said Letters Patent are hereby corrected as shown below:

Column 3, line 7, after the word "No." insert -- 3,404,805

Column 3, line 7, after the word "al" delete "3,404,805"

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*